US006561677B1

(12) United States Patent
Leen

(10) Patent No.: US 6,561,677 B1
(45) Date of Patent: May 13, 2003

(54) NIGHT LIGHT

(76) Inventor: Monte A. Leen, 11730 NE. 12th St., Bellevue, WA (US) 98005

( * ) Notice: Subject to any disclaimer, the term of this patent is extended or adjusted under 35 U.S.C. 154(b) by 0 days.

(21) Appl. No.: 10/010,902

(22) Filed: Nov. 8, 2001

(51) Int. Cl.[7] ..... F21V 1/10

(52) U.S. Cl. ..... 362/276; 362/277; 362/282; 362/286; 362/319; 362/322; 362/325; 362/290; 362/291; D26/26

(58) Field of Search ..... 362/276, 277, 362/282, 226, 319, 322, 325, 290, 291; D26/26

(56) References Cited

U.S. PATENT DOCUMENTS 5,465,197 A * 11/1995 Chien ..... 200/61.51
5,702,177 A * 12/1997 Lin ..... 362/226
6,276,813 B1 8/2001 Victor ..... 362/226
D460,204 S * 10/2001 Giese ..... D26/26

* cited by examiner

*Primary Examiner*—Sandra O'Shea
*Assistant Examiner*—Mark Tsidulko
(74) *Attorney, Agent, or Firm*—Dean A. Craine

(57) ABSTRACT

A night light having a base unit with a central cavity designed to house a light sensor, a printed circuit board, a light bulb, and a pair of electrical prongs. Attached to the front surface of the base unit is a fixed half-spherical lens. Disposed over the lens is a rotating, half-spherical cap having an approximately quarter-spherical sized opening that allows a portion of the lens to be exposed so that light from the light bulb located inside the lens may shine therethrough. Thus when the outer cap is selectively rotated around the base unit, the quarter-spherical sized opening is rotated therewith, and a dissipated broad beam of light may be selectively aimed in any 360 degree direction.

2 Claims, 2 Drawing Sheets

NIGHT LIGHT

BACKGROUND OF THE INVENTION

1. Field of the Invention

This invention pertains to the field of night lights, and in particular, to night lights that plug into standard electrical receptacles and that have caps that rotate to vary the direction of light.

2. Description of the Related Art

Night lights with rotating heads are known in the prior art. For example, U.S. Pat. No. 6,276,813 discloses a night light with a rotating head 18 on a main housing unit 12 that plugs into a standard receptacle. Attached to the outer surface of the rotating head 18 is a diagonally aligned lens 20. Because the lens 20 has a relatively small diameter and is disposed in front of the main housing unit 12 and the lens 20 is fixed to the head 18, a relatively narrow beam of light is emitted that only illuminates a relatively small surface directly in front of the lens. Because of this feature, these night lights are sold as "path" lights.

One drawback of these types of night lights is that they extend relatively far from the receptacle and can be distracting. As a result, the use of such night lights are often limited to hallways and unprotected areas where they are likely to be kicked or invite their removal by small children or dogs.

What is needed is a low profile, adjustable night light that provides a broad beam of light.

SUMMARY OF THE INVENTION

It is an object of the present invention to provide a low profile night light that does not protrude excessively from the wall.

It is another object of the present invention to provide such a night light that emits a relatively broad beam of light that illuminates a broad area of the adjacent wall or floor.

It is a further object of the present invention to provide such a night light that is selectively adjustable so that the area of illumination can be adjusted.

These and other objects of the present invention are met by a night light having a main base unit with two standard, electrical prongs designed to connect to a standard 2 or 3 prong receiving electrical receptacle. Disposed inside the base unit is a light bulb that connects to a built-in printed circuit board. Attached to the printed circuit board is a light sensor that activates the light bulb when there is insufficient light in the room. Located over the front surface of the base unit is a fixed, half-spherical, transparent or semi-transparent lens. Connected to the base unit and disposed closely over the lens is a half-spherical outer cap with a quarter-spherical opening formed thereon. The outer cap extends only a short distance from the base unit and includes a quarter-spherical sized opening that exposes approximately one-half of the lens so that light from the light bulb may shine therethrough. When the outer cap is selectively rotated around the base unit, the user changes the location of the quarter-spherical sized opening relative to the lens so that light is emitted through different areas of the spherical lens. Because the lens is spherical rather than flat, a broad beam of light is emitted that may be aimed in any 360 degree direction in relation to the light bulb.

DESCRIPTION OF THE PREFERRED EMBODIMENT(S)

Figure 1:
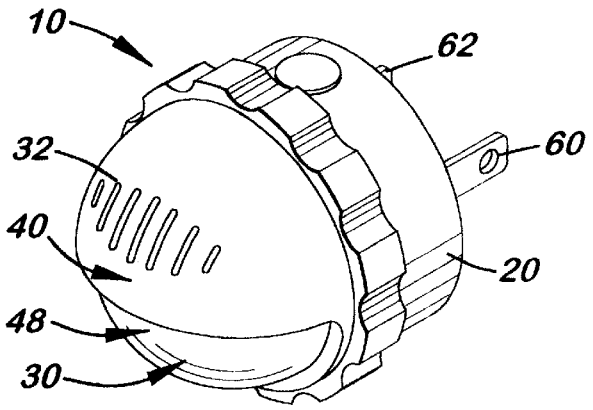
FIG. 1 is perspective view of an improved night light.
Figure 2:
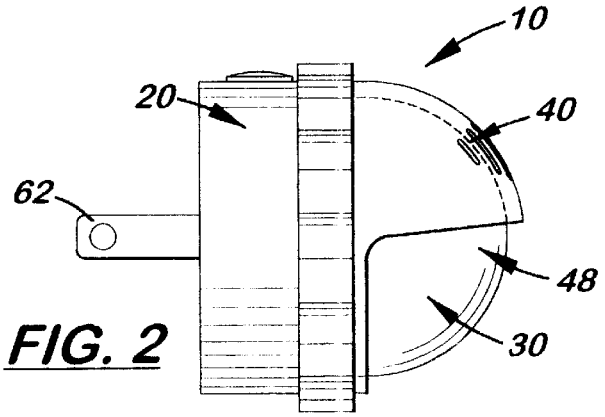
FIG. 2 is a side elevation view of the invention.
Figure 3:
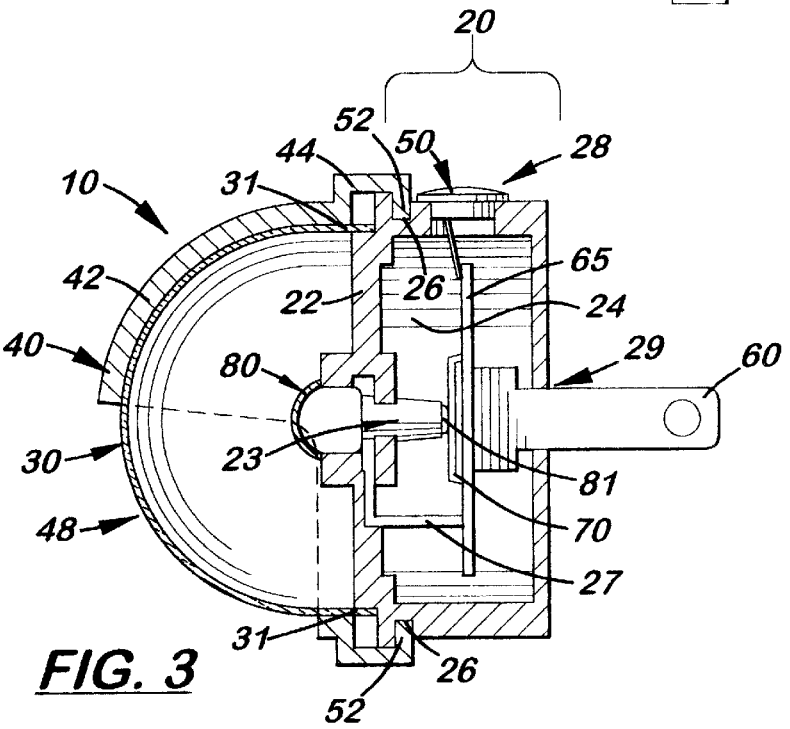
FIG. 3 is a sectional side elevational view of the invention.

Referring to the accompanying FIGS. 1 and 2, there is shown an embodiment of an improved night light 10 comprised of a cylindrical-shaped base unit 20, a rotating outer cap 40 coupled to the base unit 20, and a fixed, half-spherical lens 30 also disposed over the base unit 20 and inside the outer cap 40. As shown more clearly in FIG. 3, the base unit 20 includes an inner cavity 24 with openings 28, 29 for the light sensor 50 and two electrical prongs 60, 62 respectively, extending therefrom. Located inside the cavity 24 is a printed circuit board (PCB) 65 that is electrically connected to both the light sensor 50 and the two prongs 60, 62. Extending from the PCB 65 is a contact plate 70 that touches the lower lip contact 81 on the light bulb 80. The light bulb 80, which extends through a central opening 23 formed on the front surface 22 of the base unit 20, makes contact with the contact 81. Also located inside the central opening 23 is a contact arm 27 that touches the metal body of the bulb 80 when the light bulb 80 is extended through the central opening 23.

The lens 30 is a half spherical-structure that is fixed in position over the front surface 22 of the base unit 20. Formed on the lens 30 is a plurality of optional vents 32 that enable heat created by the light bulb 80 to escape during use.

Disposed over the lens 30 is a rotating outer cap 40 with a half-spherical body 42 integrally attached to a circular ring 44. Formed on the inside edge of the circular ring 44 is an inward extending flange surface 52, which seats into an annular groove 29 formed on the outer surface of the base unit 20 adjacent to the front surface 22. During assembly, the flange 52 seats into the groove 29 to rotatably connect the outer cap 40 to the base unit 20. Formed on the body 42 is a quarter-spherical sized opening 48. The circular edge 31 of the lens 30 is disposed under the circular ring 44 which holds the circular edge 31 in position when the circular ring 44 snap-fits into to the base unit 20.

Figure 4:
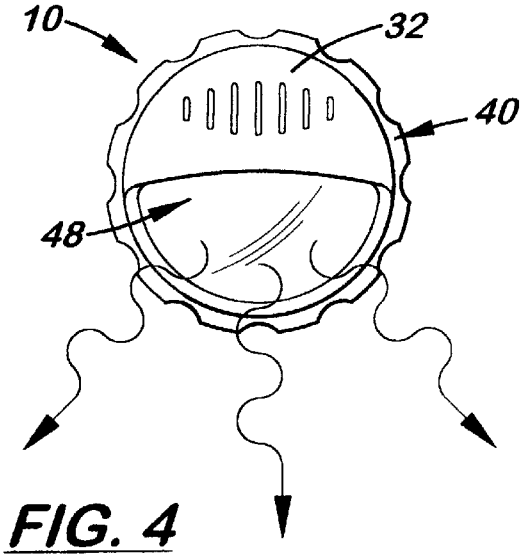
FIG. 4 is a front elevational view showing the cap rotated so that light is emitted downward.
Figure 5:
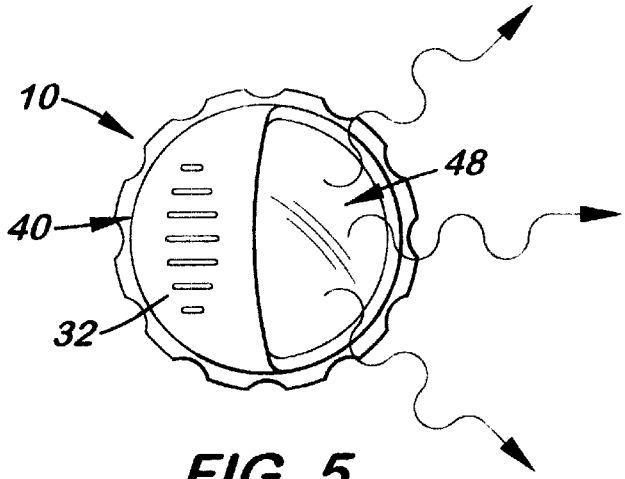
FIG. 5 is a front elevational view showing the cap rotated so that light is emitted laterally.
Figure 6:
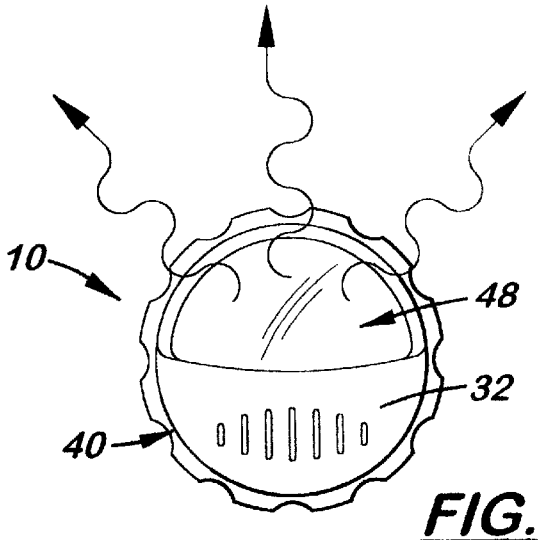
FIG. 6 a front elevational view showing the cap rotated so that light is emitted upward.

During use, the night light 10 is plugged into a standard electrical receptacle. The outer cap 40 is then selectively rotated 360 degrees, as shown in FIGS. 4–6, over the base unit 20 so that light from the light bulb 80 is emitted in any desired direction. As more clearly shown in FIGS. 4–6, the quarter-spherical sized opening 48 allows light to be emitted through the closely fitting lens 30 approximately 180 degrees. As a result, a broad illuminated area adjacent to the night light, rather than a pinpoint of illumination, is produced.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. An improved night light with a light bulb, light sensor, and a pair of electrical prongs, comprising:

a. a base unit with a set of prongs extending therefrom for connection to an electrical receptacle;

b. a fixed, half-spherical lens located over the front surface of said base unit;

c. a rotating, half-spherical outer cap disposed over said base unit and said half-spherical lens, said outer cap being complementary in shape with said lens and including a quarter-spherical sized opening through which light is allowed to be emitted through said lens, said outer cap including at least one inward extending flange located along the perimeter edge of said outer cap; and, d. an annular groove located near said base unit, said flange seated within said groove rotatably securing said outer cap to said base unit.

2. The night light as recited in claim 1, further including a plurality of openings formed on said outer cap thereby enabling additional light to be emitted from said night light.

* * * * *